US009222672B2

(12) United States Patent
Kodukulla et al.

(10) Patent No.: US 9,222,672 B2
(45) Date of Patent: Dec. 29, 2015

(54) COMBUSTOR LINER COOLING ASSEMBLY

(75) Inventors: Sridhar Venkat Kodukulla, Karnataka (IN); Sandeep Gopalakrishna, Karnataka (IN)

(73) Assignee: General Electric Company, Schenectady, NY (US)

( * ) Notice: Subject to any disclaimer, the term of this patent is extended or adjusted under 35 U.S.C. 154(b) by 376 days.

(21) Appl. No.: 13/585,548

(22) Filed: Aug. 14, 2012

(65) Prior Publication Data

US 2014/0047845 A1 Feb. 20, 2014

(51) Int. Cl.

| | |
|---|---|
| ***F23R 3/06*** | (2006.01) |
| ***F23R 3/00*** | (2006.01) |
| ***F23R 3/60*** | (2006.01) |
| ***F23R 3/08*** | (2006.01) |
| ***F23R 3/46*** | (2006.01) |

(52) U.S. Cl.

CPC . *F23R 3/005* (2013.01); *F23R 3/06* (2013.01); *F23R 3/08* (2013.01); *F23R 3/46* (2013.01); *F23R 3/60* (2013.01); *F23R 2900/00012* (2013.01); *F23R 2900/03041* (2013.01); *F23R 2900/03042* (2013.01); *F23R 2900/03043* (2013.01); *F23R 2900/03044* (2013.01)

(58) Field of Classification Search

CPC ..... F23R 3/06; F23R 3/54; F23R 3/60; F23R 3/46; F23R 2900/00012; F23R 2900/00017; F23R 2900/03042; F23R 2900/03043; F23R 29/03044; F23R 2900/03045; F01D 9/023; F01D 9/09; F02K 1/822

USPC ..... 60/752–760, 39.37

See application file for complete search history.

(56) References Cited

U.S. PATENT DOCUMENTS

| | | | |
|---|---|---|---|
| 5,724,816 | A | 3/1998 | Ritter et al. |
| 7,269,957 | B2 | 9/2007 | Martling et al. |
| 7,493,767 | B2 | 2/2009 | Bunker et al. |
| 2009/0120096 | A1 | 5/2009 | Tuthill |
| 2010/0186415 | A1 | 7/2010 | Brown et al. |
| 2010/0229564 | A1 * | 9/2010 | Chila ..... 60/752 |
| 2011/0120135 | A1 | 5/2011 | Johnson et al. |
| 2012/0036858 | A1 | 2/2012 | Lacy et al. |
| 2014/0033726 | A1 | 2/2014 | Chen et al. |

FOREIGN PATENT DOCUMENTS

| | | | |
|---|---|---|---|
| EP | 0521687 | A1 | 1/1993 |

* cited by examiner

*Primary Examiner* — Phutthiwat Wongwian
*Assistant Examiner* — Marc Amar
(74) *Attorney, Agent, or Firm* — Ernest G. Cusick; Frank A. Landgraff

(57) ABSTRACT

A combustor liner defining a combustor chamber is included. Also included is a cover sleeve spaced radially outwardly from and at least partially surrounding an aft end of the combustor liner, the cover sleeve and the combustor liner defining a cooling annulus. Further included is at least one aperture extending through the cover sleeve for routing a cooling flow to the cooling annulus. Yet further included is a perforated sleeve disposed between the cover sleeve and the combustor liner, wherein the perforated sleeve comprises a plurality of holes for impinging the cooling flow toward the combustor liner.

17 Claims, 6 Drawing Sheets

COMBUSTOR LINER COOLING ASSEMBLY

BACKGROUND OF THE INVENTION

The subject matter disclosed herein relates to gas turbine systems, and more particularly to a combustor liner cooling assembly.

A combustor section of a gas turbine system typically includes a combustor chamber disposed relatively adjacent a transition piece, where a hot gas passes from the combustor chamber through the transition piece to a turbine section. As firing temperatures within the combustor chamber increase and NOx allowances are reduced, meeting combustor liner life requirements becomes increasingly challenging with currently employed cooling schemes.

One region of the combustor liner requiring effective cooling includes an aft end of the combustor liner, with one common cooling method including channel cooling. Channel cooling typically includes providing a cooling flow to a channel, then subsequently expelling the cooling flow to a region of the transition piece. Unfortunately, the useful length of the channel cooling is dependent on the temperature of the air in the cooling channel, thereby often rendering ineffective cooling of significant portions of the combustor liner due to increased firing temperatures and increased compressor discharge air temperatures. Alternatively, film cooling may be employed at various locations in the combustor chamber. Film cooling typically includes providing air from a plenum between a flow sleeve and the combustor liner to provide a barrier between the hot gas and the combustor liner. Unfortunately, the benefit of the barrier lasts for a finite length and is largely dependent on the flow in the film cooled region and not the temperature of the film gas. Therefore, either singular cooling scheme often does not achieve desired cooling performance of the aft end of the combustor liner.

BRIEF DESCRIPTION OF THE INVENTION

According to one aspect of the invention, a combustor liner cooling assembly includes a combustor liner defining a combustor chamber. Also included is a cover sleeve spaced radially outwardly from and at least partially surrounding an aft end of the combustor liner, the cover sleeve and the combustor liner defining a cooling annulus. Further included is at least one aperture extending through the cover sleeve for routing a cooling flow to the cooling annulus. Yet further included is a perforated sleeve disposed between the cover sleeve and the combustor liner, wherein the perforated sleeve comprises a plurality of holes for impinging the cooling flow toward the combustor liner.

According to another aspect of the invention, a combustor liner cooling assembly includes a combustor liner defining a combustor chamber, wherein the combustor liner includes an outer surface and an inner surface. Also included is a cover sleeve spaced radially outwardly from and at least partially surrounding an aft end of the combustor liner, the cover sleeve and the outer surface of the combustor liner defining an annulus, wherein a cooling flow is routed to the annulus through an aperture extending through the cover sleeve. Further included is at least one protuberance extending radially outwardly from the outer surface of the combustor liner for increasing a surface area of the outer surface for increasing heat transfer proximate the aft end of the combustor liner and disrupting a boundary layer proximate the aft end of the combustor liner.

According to yet another aspect of the invention, a gas turbine system includes a combustor liner defining a combustor chamber, wherein the combustor liner includes an outer surface and an inner surface. Also included is a flow sleeve disposed radially outwardly of the outer surface of the combustor liner and having a first plurality of cooling apertures for directing compressor discharge air into a first flow annulus defined by the flow sleeve and the combustor liner. Further included is a transition piece operably connected to the combustor liner and configured to carry hot combustion gases to a turbine section of the gas turbine system. Yet further included is an impingement sleeve surrounding the transition piece and having a second plurality of cooling apertures for directing compressor discharge air into a second annulus defined by the transition piece and the impingement sleeve. The gas turbine system also includes a resilient seal structure disposed radially between an aft end of the combustor liner and a forward end of the transition piece. Further included is a cover sleeve spaced radially outwardly from and at least partially surrounding the end region of the combustor liner, the cover sleeve and the combustor liner defining a cooling annulus. Yet further included is a perforated sleeve disposed between the cover sleeve and the combustor liner, wherein the perforated sleeve comprises a plurality of holes for impinging a cooling flow toward the outer surface of the combustor liner.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
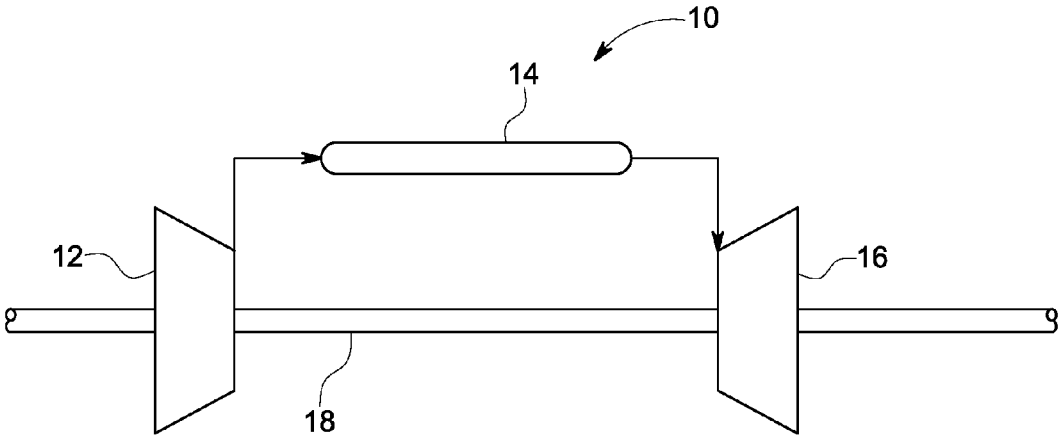
FIG. 1 is a schematic illustration of a gas turbine system.

With reference to FIG. 1, a turbine system, such as a gas turbine system, for example, is schematically illustrated with reference numeral 10. The gas turbine system 10 includes a compressor section 12, a combustor section 14, a turbine section 16 and a shaft 18. It is to be appreciated that one embodiment of the gas turbine system 10 may include a plurality of compressors 12, combustors 14, turbines 16 and shafts 18. The compressor section 12 and the turbine section 16 are coupled by the shaft 18. The shaft 18 may be a single shaft or a plurality of shaft segments coupled together to form the shaft 18.

Figure 2:
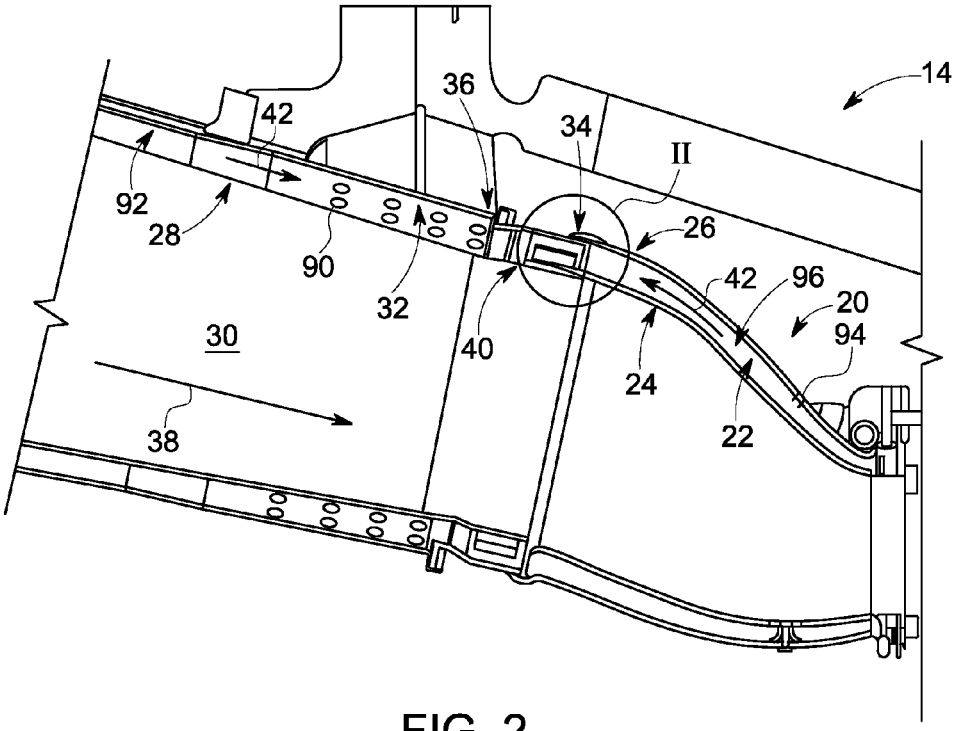
FIG. 2 is a partial, schematic illustration of a combustor section of the gas turbine system.

Referring to FIG. 2, a partial schematic illustrates a portion of the combustor section 14 of a gas turbine system 10 in greater detail. The combustor section 14 includes a transition piece 20 having a transition duct 22 at least partially surrounded by an impingement sleeve 24 disposed radially outwardly of the transition duct 22. Upstream thereof, proximate a forward portion 26 of the impingement sleeve 24 is a combustor liner 28 defining a combustor chamber 30. The combustor liner 28 is at least partially surrounded by a flow sleeve 32 disposed radially outwardly of the combustor liner 28. The flow sleeve 32 includes a first plurality of apertures 90 for directing compressor discharge air into a first annulus 92 defined by the flow sleeve 32 and the combustor liner 28. Similarly, the impingement sleeve 24 includes a second plurality of apertures 94 for directing compressor discharge air into a second annulus 96 defined by the impingement sleeve 24 and the transition duct 22. A forward sleeve 34 is located at the junction between the forward portion 26 of the impingement sleeve 24 and an aft portion 36 of the flow sleeve 32.

The combustor section 14 uses a combustible liquid and/or gas fuel, such as a natural gas or a hydrogen rich synthetic gas, to run the gas turbine system 10. The combustor chamber 30 is configured to receive and/or provide an air-fuel mixture, thereby causing a combustion that creates a hot pressurized exhaust gas flowing as a hot gas path 38. The combustor chamber 30 directs the hot pressurized gas through the transition piece 20 into the turbine section 16 (FIG. 1), causing rotation of the turbine section 16. The presence of the hot pressurized exhaust gas increases the temperature of the combustor liner 28 surrounding the combustor chamber 30, particularly proximate an aft end 40 of the combustor liner 28. To overcome issues associated with excessive thermal exposure to the combustor liner 28, a cooling flow 42 flows from downstream to upstream along the combustor liner 28 in a relatively opposite direction to that of the hot gas path 38. Specifically, the cooling flow 42 flows from the second annulus 96 defined by the impingement sleeve 24 and the transition duct 22 toward the first annulus 92 defined by the flow sleeve 32 and the combustor liner 28.

Figure 3:
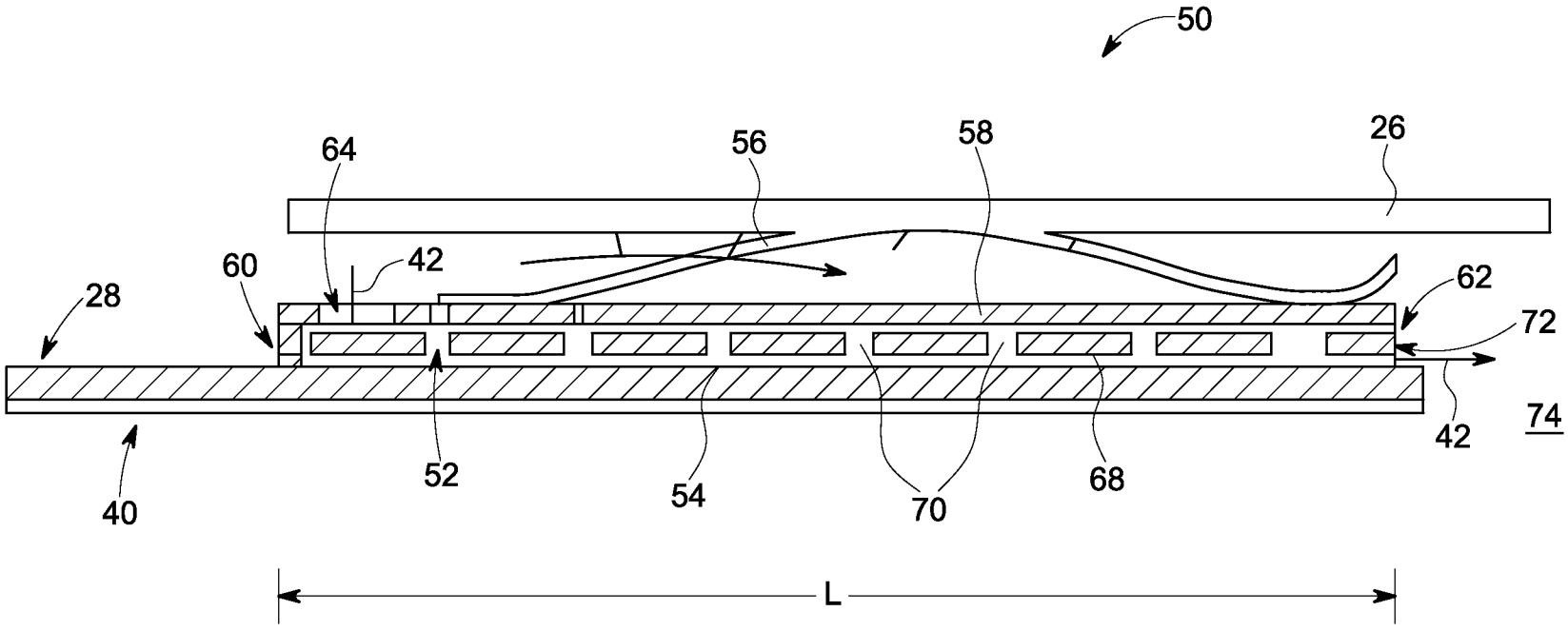
FIG. 3 is an enlarged view of section II of FIG. 2, illustrating a combustor liner cooling assembly according to a first embodiment.

Referring now to FIG. 3, an enlarged cross-sectional view of the aft end 40 of the combustor liner 28 is shown in greater detail and illustrates a combustor liner cooling assembly 50 according to a first embodiment. At least one portion of the combustor liner cooling assembly 50 includes a cooling annulus 52 defined by an outer surface 54 of the combustor liner 28 and a cover sleeve 58, which is disposed radially outwardly of the combustor liner 28. Although the cover sleeve 58 typically fully surrounds the combustor liner 28 proximate the aft end 40, it is contemplated that the cover sleeve 58 only extends partially around the aft end 40 in a circumferential direction. As defined by the combustor liner 28 and the cover sleeve 58, the cooling annulus 52 extends circumferentially around the outer surface 54 of the combustor liner 28 and along a relatively axial direction of the combustor liner 28, thereby comprising a length L.

In an exemplary embodiment, a resilient, compression-type seal 56, such as a hula seal, is mounted between the cover sleeve 58 and a portion of the forward sleeve 34 or alternatively the forward portion 26 of the impingement sleeve 24. The cover sleeve 58 is mounted on the combustor liner 28 to form a mounting surface for the resilient, compression-type seal 56.

The cooling annulus 52 also includes a forward region 60 and an aft region 62 that define the length L. It is to be appreciated that the cooling annulus 52 may be in the form of various dimensions and will be based on numerous parameters of the application employed in conjunction with. For example, the length L, the circumferential dimensional distance and the depth of the cooling annulus 52 may all vary. Irrespective of the precise dimensions, the cooling annulus 52 is configured to receive the cooling flow 42 through an aperture 64 disposed in the cover sleeve 58. The aperture 64 extends through the cover sleeve 58 and it is to be understood that the aperture 64 may be aligned relatively perpendicularly to the cooling flow 42 or at an angle thereto. Although it is contemplated that the aperture 64 may be disposed at numerous locations along the length L of the cooling annulus 52, typically the aperture 64 is located proximate the forward region 60 of the cooling annulus 52. At least a portion of the cooling flow 42 is routed into the aperture 64 and flows throughout the cooling annulus 52.

A perforated sleeve 68 is disposed within the cooling annulus 52 at a location radially inwardly of the cover sleeve 58 and radially outwardly of the combustor liner 28. The perforated sleeve 68 includes a plurality of axially spaced holes 70 extending therethrough for impinging the cooling flow 42 toward and onto the outer surface 54 of the combustor liner 28 for cooling of the aft end 40 as the cooling flow 42 is received into the cooling annulus 52. In combination with impingement of the cooling flow 42 onto the outer surface 54 of the combustor liner 28, the cooling flow 42 is routed along the outer surface 54 in a relatively axial direction to provide additional convective cooling.

At least one escape orifice 72 disposed proximate the aft region 62 extends from the cooling annulus 52 to an exterior region 74, relative to the cooling annulus 52. In the illustrated embodiment, the exterior region 74 corresponds to the second annulus 96 defined by the impingement sleeve 24 and the combustor liner 28 or the transition duct 22. The escape orifice 72 provides an exit for the cooling flow 42 flowing within the cooling annulus 52 and such a flow tendency is achieved based on the exterior region 74 being at a lower pressure than the cooling annulus 52. As is the case with the aperture 64 described above, it is also contemplated that the escape orifice 72 may be located at various axial locations along the length L of the cooling annulus 52, however, typically the escape orifice 72 is disposed proximate the aft region 62 of the cooling annulus 52, as illustrated and described above. Additionally, it is to be appreciated that the escape orifice 72 may be aligned at numerous angles, including parallel to the direction of flow of the cooling flow 42. It is also to be appreciated that the location of the exterior region 74 to which the cooling flow 42 is expelled may vary, as will be described in detail below with reference to alternative embodiments.

With respect to each of the escape orifices 72, it is contemplated that a plurality of low-angle, round holes may be circumferentially spaced and arranged in a relatively single axial plane. Alternatively, multiple rows may be included to provide axially staggered escape orifices. As noted above, the escape orifices 72 may be aligned at various angles, with respect to a surface tangent of the combustor liner 28. For example, the escape orifice 72 may be aligned at an angle of about 15 degrees to about 90 degrees. In addition to the above-described single angle configuration, it is contemplated that a secondary, or compound, angle may be present to form a first angled portion and a second angled portion of the escape orifice 72. In such an embodiment, the secondary, or compound, angle may be aligned at about 0 degrees to about 50 degrees, with respect to the axial direction of the first angled portion.

Although the combustor section 10 is illustrated and described above as having a single aperture and a single escape orifice, it is to be understood that a plurality of either or both of the aperture 64 and/or the escape orifice 72 is typically included and the escape orifice 72 may be configured as a single, circumferential annular portion rather than one or more orifices. Specifically, for embodiments having a plurality of apertures and/or escape orifices, such features may be present at any location along the length L of the cooling annulus 52, however, as with the case of the embodiments described above, the apertures and/or escape orifices are typically disposed proximate the forward region 60 and the aft region 62, respectively. Such an embodiment includes circumferentially spaced apertures and/or escape orifices, with the spacing between such features ranging depending on the application of use.

Figure 4:
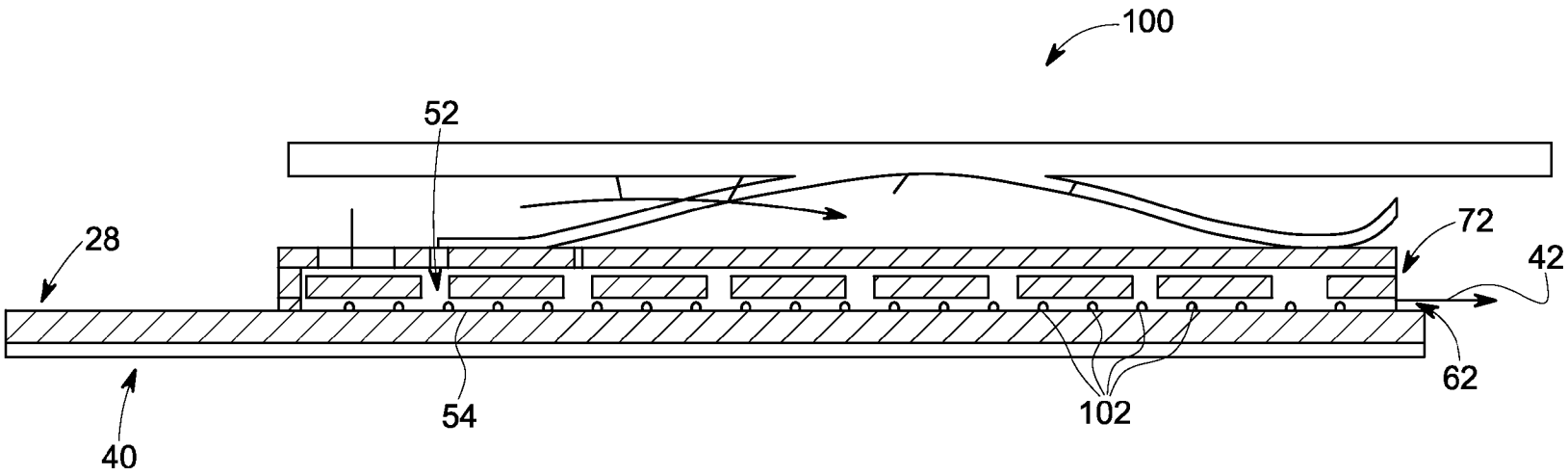
FIG. 4 is an enlarged view of section II of FIG. 2, illustrating the combustor liner cooling assembly according to a second embodiment.

Referring now to FIG. 4, an enlarged cross-sectional view of the aft end 40 of the combustor liner 28 according to a second embodiment of a combustor liner cooling assembly 100 is shown in greater detail. The second embodiment of the combustor liner cooling assembly 100 is similar in many respects to that of the first embodiment, including the disposal of the escape orifice 72 proximate the aft region 62 of the cooling annulus 52 for drawing the cooling flow 42 out of the cooling annulus 52, thereby providing an efficient convective channel cooling effect on the combustor liner 28, in addition to the impingement cooling. In addition to the above-described features, the outer surface 54 of the combustor liner 28 includes a plurality of flow manipulating components 102, such as turbulators. The flow manipulating components 102 comprise a discrete or individual circular ring defined by a raised peripheral rib that extends circumferentially around the outer surface 54 of the combustor liner 28. The flow manipulating components 102 are typically parallel to one another in an axially spaced arrangement, but it is contemplated that the flow manipulating components 102 are arranged in an angled arrangement, such as a helical pattern. The flow manipulating components 102 may be disposed at any location within the cooling annulus 52 to enhance the cooling of the combustor liner 28. Additionally, the flow manipulating components 102 may form a "zig-zag" pattern that changes direction around the outer surface 54. Although turbulators are mentioned as forming the flow manipulating components 102, numerous suitable alternative shapes, such as dimples and chevrons may be employed to sufficiently form vortices for improving heat transfer and thermal uniformity along the aft end 40 of the combustor liner 28. Furthermore, the flow manipulating components 102 provide increased turbulence by disruption of a boundary layer typically generated proximate the aft end 40 of the combustor liner 28.

Figure 5:
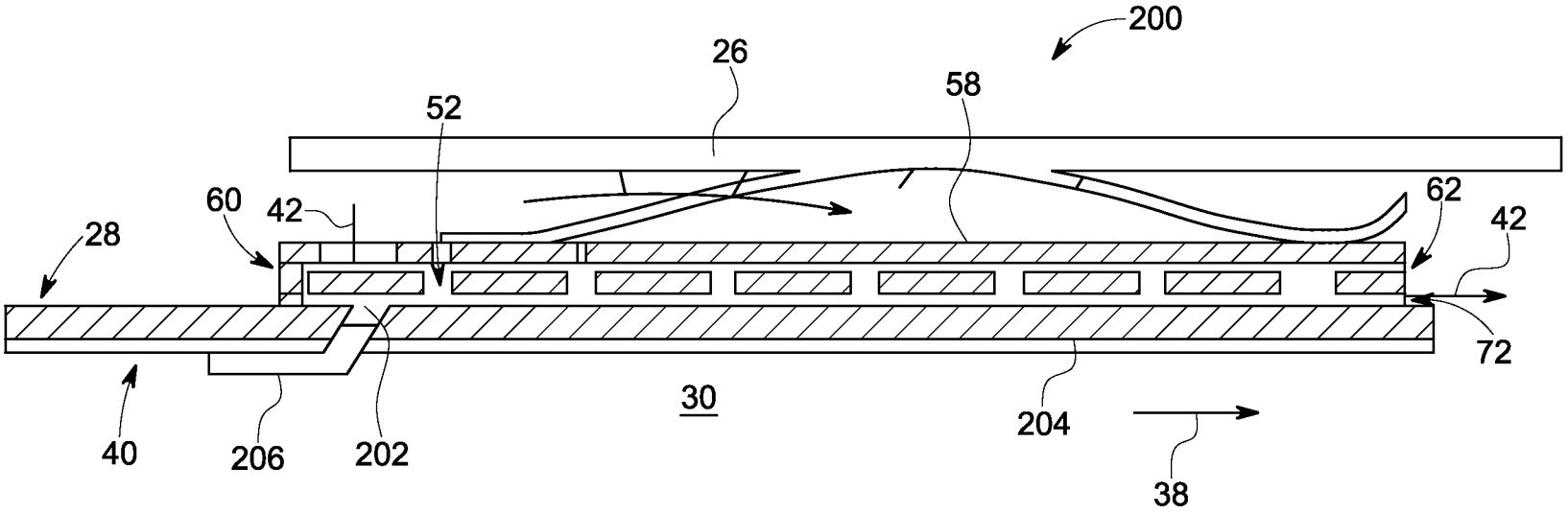
FIG. 5 is an enlarged view of section II of FIG. 2, illustrating the combustor liner cooling assembly according to a third embodiment.

Referring now to FIG. 5, an enlarged cross-sectional view of the aft end 40 of the combustor liner 28 according to a third embodiment of the combustor liner cooling assembly 200 is shown in greater detail. The third embodiment of the combustor liner cooling assembly 200 is similar in many respects to that of the previously described embodiments, however, the cooling flow 42 routed into the cooling annulus 52 is expelled through at least one cooling flow path 202, which may be referred to interchangeably with the escape orifice 72, with the at least one cooling flow path 202 extending through the combustor liner 28 from the cooling annulus 52 to a combustor liner inner surface 204, with the combustor liner inner surface 204 being exposed to the hot gas path 38 within the combustor chamber 30. The at least one cooling flow path 202 provides an exit for the cooling flow 42 flowing within the cooling annulus 52 and such a flow tendency is achieved based on the combustor chamber 30 being at a lower pressure than the cooling annulus 52, as well as the region defined by the cover sleeve 58 and the forward sleeve 34 or alternatively the forward portion 26 of the impingement sleeve 24. The at least one cooling flow path 202 may be located at various axial locations along the length L of the cooling annulus 52, however, typically the at least one cooling flow path 202 is disposed proximate the forward region 60 or the aft region 62 of the cooling annulus 52, or both. Additionally, it is to be appreciated that the at least one cooling flow path 202 may be aligned at numerous angles, including perpendicularly to the direction of flow of the cooling flow 42 and the hot gas path 38.

As is the case with the escape orifice 72 described in conjunction with the previous embodiments, although the combustor liner cooling assembly 200 is illustrated and described above as having a single aperture and a single cooling flow path, it is to be appreciated that a plurality of either or both of the aperture 64 and/or the at least one cooling flow path 202 may be included. Such an embodiment includes circumferentially and/or axially spaced apertures and cooling flow paths, with the spacing between such features ranging depending on the application of use.

In operation, subsequent to cooling of the combustor liner 28 due to the presence of the cooling flow 42 within the cooling annulus 52, based on impingement and convective cross-flow, the cooling flow 42 is expelled from the cooling annulus 52 through the at least one cooling flow path 202. The cooling flow 42 is then routed along a portion of the combustor liner inner surface 204, thereby providing a film cooling barrier 206 between the hot gas path 38 and the combustor liner inner surface 204.

Figure 6:
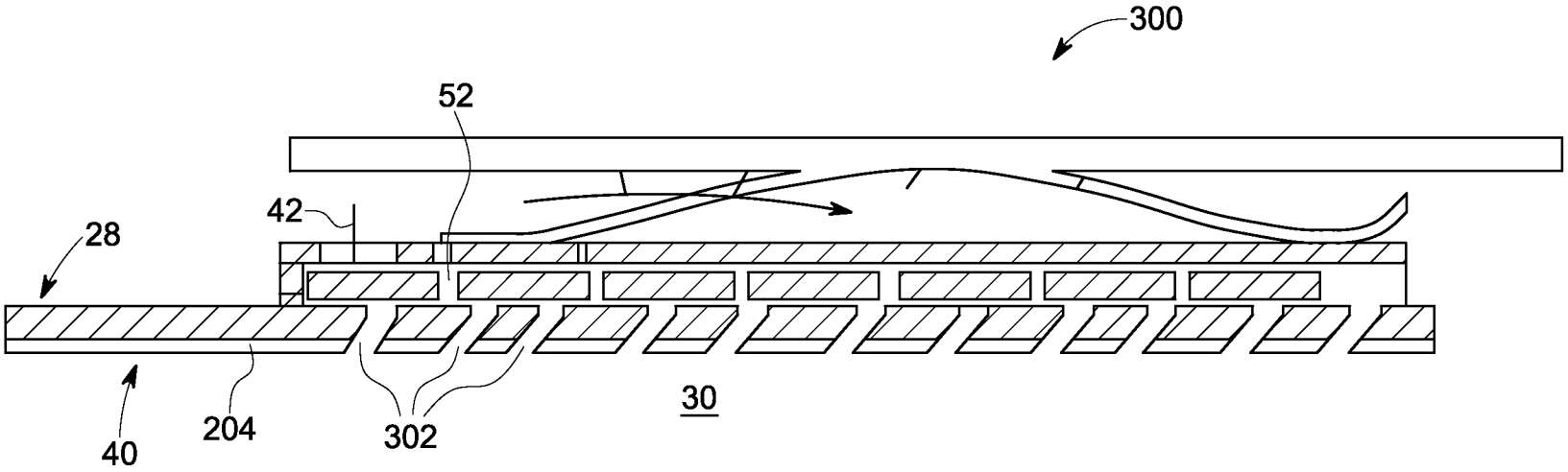
FIG. 6 is an enlarged view of section II of FIG. 2, illustrating the combustor liner cooling assembly according to a fourth embodiment.

Referring to FIG. 6, an enlarged cross-sectional view of the aft end 40 of the combustor liner 28 according to a fourth embodiment of a combustor liner cooling assembly 300 is shown in greater detail. The fourth embodiment of the combustor liner cooling assembly 300 is similar in many respects to that of the previously described embodiments, particularly the third embodiment. Rather than a single cooling flow path, a plurality of cooling flow paths 302 extend through the combustor liner 28 from the cooling annulus 52 to the combustor liner inner surface 204. The plurality of cooling flow paths 302 may be aligned at numerous angles and may be of numerous and varying size. Subsequent to cooling of the combustor liner 28 due to the presence of the cooling flow 42 within the cooling annulus 52, based on impingement and convective cross-flow, the cooling flow 42 is expelled from the cooling annulus 52 through the plurality of cooling flow paths 302 to provide effusion cooling of a region within the combustor chamber 30 proximate the combustor liner inner surface 204.

It is to be appreciated that either or both of the above-described third and fourth embodiments of the combustor liner cooling assembly 200, 300, respectively, may include the escape orifice 72 described in conjunction with the first and second embodiments, as illustrated by way of example for the third embodiment in FIG. 8.

Figure 7:
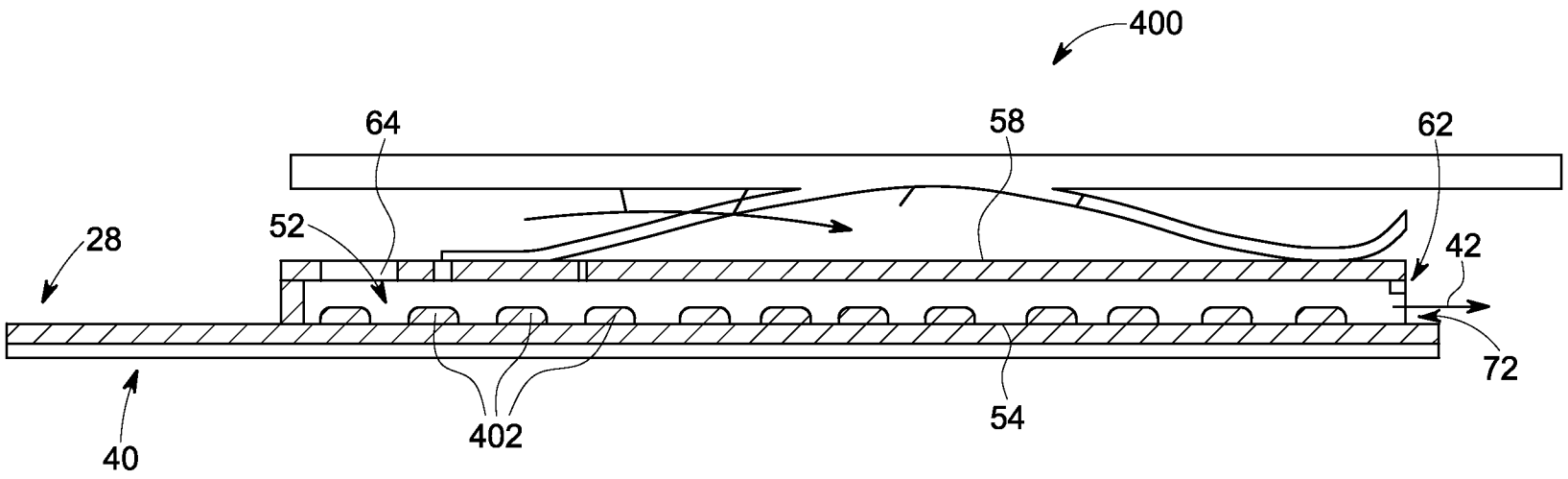
FIG. 7 is an enlarged view of section II of FIG. 2, illustrating the combustor liner cooling assembly according to a fifth embodiment.

Referring to FIG. 7, an enlarged cross-sectional view of the aft end 40 of the combustor liner 28 according to a fifth embodiment of a combustor liner cooling assembly 400 is shown in greater detail. The fifth embodiment of the combustor liner cooling assembly 400 is similar in many respects to that of the previously described embodiments, however, the fifth embodiment does not include the perforated sleeve 68 within the cooling annulus 52, as is the case with all of the previously described embodiments, or a cooling flow path, as described with respect to the third and fourth embodiments.

The fifth embodiment includes the aperture 64 to route the cooling flow 42 to the cooling annulus 52 and the escape orifice 72 proximate the aft region 62 of the cooling annulus 52 for expelling of the cooling flow 42 therefrom. In addition to the above-described features, at least one, but typically a plurality of protuberances 402 are disposed along the outer surface 54 of the combustor liner 28, with each of the plurality of protuberances 402 extending radially away from the outer surface 54 toward the cover sleeve 58. The plurality of protuberances 402 are typically axially spaced from one another and may be arranged in any manner, such as an "in-line" or "staggered" relationship. The in-line relationship refers to rows aligned with respect to a circumferential position on the combustor liner 28. The staggered relationship refers to an arrangement where axially adjacent protuberances are not circumferentially aligned. The plurality of protuberances 402 increase the surface area of the outer surface 54 of the combustor liner 28 within the cooling annulus 52, thereby enhancing heat transfer proximate the aft end 40 of the combustor liner.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor liner cooling assembly comprising:

a combustor liner defining a combustion chamber;

a cover sleeve spaced radially outwardly from and at least partially surrounding an aft end of the combustor liner, the cover sleeve and the combustor liner defining a cooling annulus therebetween;

at least one aperture extending through the cover sleeve for routing a cooling flow to the cooling annulus for convective cooling along the combustor liner within the cooling annulus;

a perforated sleeve disposed in the cooling annulus between the cover sleeve and the combustor liner, wherein the perforated sleeve comprises a plurality of holes for impinging the cooling flow toward the combustor liner; and an outer sleeve surrounding the cover sleeve, the outer sleeve comprising at least one of a flow sleeve and an impingement sleeve.

2. The combustor liner cooling assembly of claim 1, wherein the cooling annulus includes a forward region and an aft region, and wherein the at least one aperture extending through the cover sleeve is disposed proximate the forward region.

3. The combustor liner cooling assembly of claim 2, wherein the aft region comprises an escape orifice aligned to expel the cooling flow axially out of the cooling annulus.

4. The combustor liner cooling assembly of claim 1, further comprising a plurality of flow manipulating components disposed along an outer surface of the combustor liner.

5. The combustor liner cooling assembly of claim 4, wherein the plurality of flow manipulating components extend circumferentially around the outer surface of the combustor liner and are axially spaced from one another.

6. The combustor liner cooling assembly of claim 4, wherein the plurality of flow manipulating components comprises at least one of a dimple, a turbulator and a chevron.

7. The combustor liner cooling assembly of claim 4, further comprising at least one cooling flow path extending between the cooling annulus and the combustor chamber through the combustor liner for routing the cooling flow into the combustor chamber to a location proximate an inner surface of the combustor liner for cooling therealong.

8. The combustor liner cooling assembly of claim 1, further comprising at least one cooling flow path extending between the cooling annulus and the combustor chamber through the combustor liner for routing the cooling flow into the combustor chamber to a location proximate an inner surface of the combustor liner for cooling therealong.

9. The combustor liner cooling assembly of claim 8, wherein the at least one cooling flow path routes the cooling flow along a portion of the inner surface within the combustor chamber, thereby forming a cooling film layer.

10. A gas turbine system comprising:

a combustor liner defining a combustor chamber, wherein the combustor liner includes an outer surface and an inner surface;

a flow sleeve disposed radially outwardly of the outer surface of the combustor liner and having a first plurality of cooling apertures for directing compressor discharge air into a first flow annulus defined by the flow sleeve and the combustor liner;

a transition piece operably connected to the combustor liner and configured to carry hot combustion gases to a turbine section of the gas turbine system;

an impingement sleeve surrounding the transition piece and having a second plurality of cooling apertures for directing compressor discharge air into a second flow annulus defined by the transition piece and the impingement sleeve;

a cover sleeve spaced radially outwardly from and at least partially surrounding the aft end of the combustor liner, the cover sleeve and the combustor liner defining therebetween a cooling annulus for convective cooling along the combustor liner within the cooling annulus;

a resilient seal structure disposed radially outwardly of, and in contact with, the cover sleeve and in further contact with one of a forward portion of the impingement sleeve and an aft portion of the flow sleeve; and a perforated sleeve disposed between the cover sleeve and the combustor liner, wherein the perforated sleeve comprises a plurality of holes for impinging a cooling flow toward the outer surface of the combustor liner.

11. The gas turbine system of claim 10, wherein the cooling annulus includes a forward region and an aft region, and wherein the cover sleeve defines at least one aperture therethrough, the at least one aperture being disposed proximate the forward region for routing the cooling flow to the cooling annulus.

12. The gas turbine system of claim 10, further comprising a plurality of flow manipulating components disposed along the outer surface of the combustor liner.

13. The gas turbine system of claim 12, wherein the plurality of flow manipulating components extend circumferentially around the outer surface of the combustor liner and are axially spaced apart from one another.

14. The gas turbine system of claim 12, wherein the plurality of flow manipulating components comprises at least one of a dimple, a turbulator and a chevron.

15. The gas turbine system of claim 12, further comprising at least one cooling flow path extending between the cooling annulus and the combustor chamber through the combustor liner for routing the cooling flow into the combustor chamber to a location proximate the inner surface of the combustor liner for cooling therealong.

16. The gas turbine system of claim 10, further comprising at least one cooling flow path extending between the cooling annulus and the combustor chamber through the combustor liner for routing the cooling flow into the combustor chamber to a location proximate the inner surface of the combustor liner for cooling therealong.

17. The gas turbine system of claim 16, wherein the at least one cooling flow path routes the cooling flow along a portion of the inner surface within the combustor chamber, thereby forming a cooling film layer.

* * * * *